United States Patent [19]

Halicki

[11] 4,180,011

[45] Dec. 25, 1979

[54] APPARATUS FOR SPRAYING A COATING ON THE INSIDE SURFACES OF LONGITUDINAL SEAMS ON CAN BODIES

[75] Inventor: Frank E. Halicki, Oak Lawn, Ill.

[73] Assignee: The Sherwin-Williams Company, Cleveland, Ohio

[21] Appl. No.: 832,528

[22] Filed: Sep. 12, 1977

[51] Int. Cl.[2] ..... B05C 7/02

[52] U.S. Cl. ..... 118/685; 118/DIG. 10; 118/317; 239/411; 427/236

[58] Field of Search ..... 118/DIG. 10, 2, 317; 239/411; 427/236

[56] References Cited

U.S. PATENT DOCUMENTS

| | | | |
|---|---|---|---|
| 2,124,853 | 7/1938 | Grupe | 118/317 X |
| 2,348,495 | 5/1944 | Peterson, Jr. | 118/317 X |
| 2,693,782 | 11/1954 | Moore | 118/2 |
| 2,763,575 | 9/1956 | Bede | 118/302 X |
| 2,895,449 | 7/1959 | Oldfield, Jr. | 118/317 X |
| 2,961,990 | 11/1960 | Wruck | 118/2 |
| 3,081,947 | 3/1963 | Walter | 118/317 X |
| 3,104,986 | 9/1963 | Goman et al. | 118/2 |
| 3,526,027 | 9/1970 | Manuel et al. | 118/317 X |
| 3,654,898 | 4/1972 | Galitz | 118/323 |
| 3,702,107 | 11/1972 | Rood et al. | 118/2 |
| 3,815,544 | 6/1974 | Rood et al. | 118/2 |
| 3,816,165 | 6/1974 | Horvath et al. | 118/2 X |
| 3,921,570 | 11/1975 | Hogstrom et al. | 118/2 |
| 3,923,252 | 12/1975 | Warning, Sr. et al. | 239/411 |
| 3,995,075 | 11/1976 | Cernaulkas et al. | 118/2 X |

*Primary Examiner*—Robert Mackey
*Attorney, Agent, or Firm*—Fay & Sharpe

[57] ABSTRACT

The inside surfaces of longitudinal seams on can bodies are sprayed with a coating by moving the can bodies longitudinally along an arm with the seams spaced vertically above the arm. An air spray nozzle mounted on the arm is positioned for air spraying a coating material vertically upwardly against the inside surfaces of the longitudinal seams as the can bodies move past the nozzle.

6 Claims, 5 Drawing Figures

FIG. 1
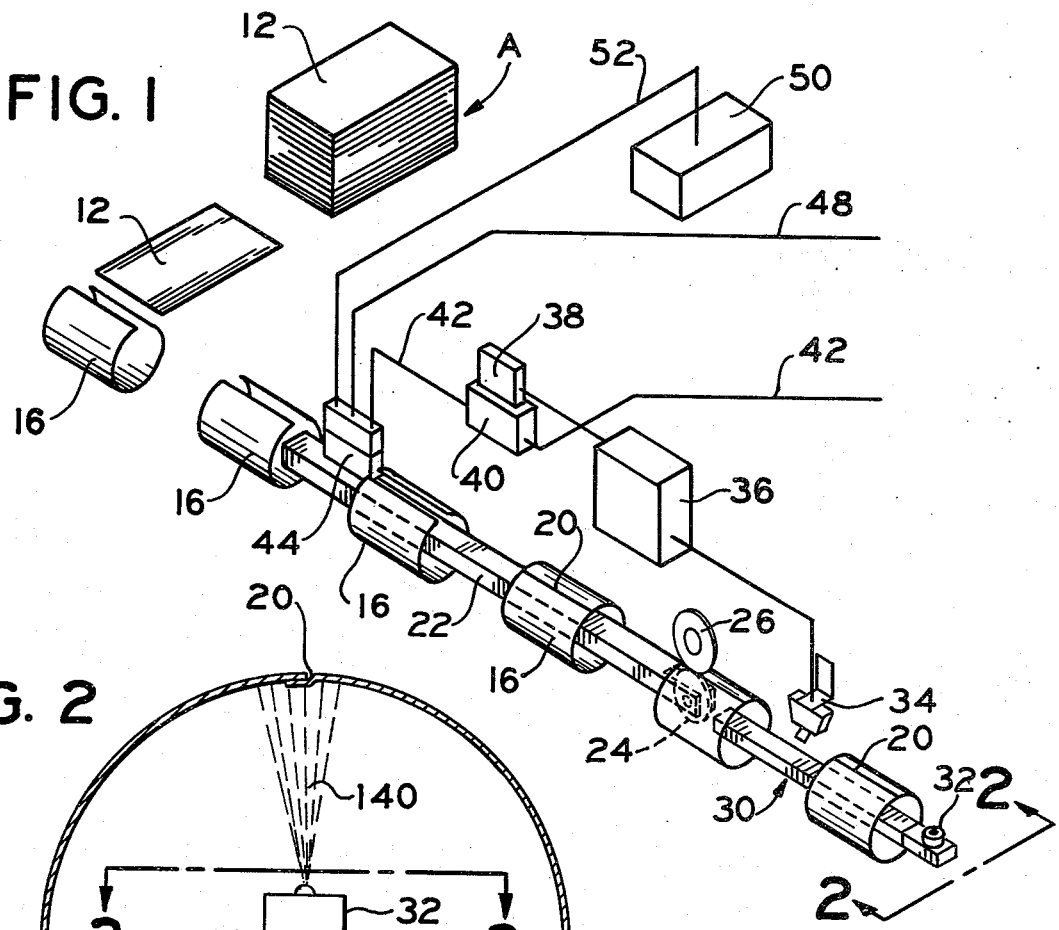
FIG. 2
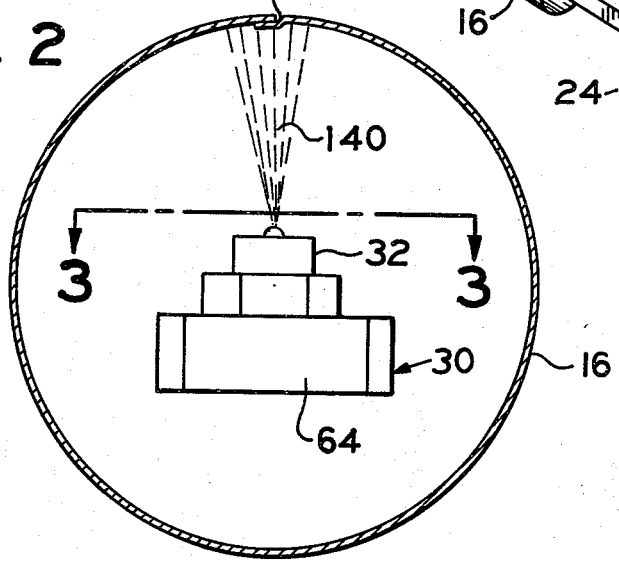
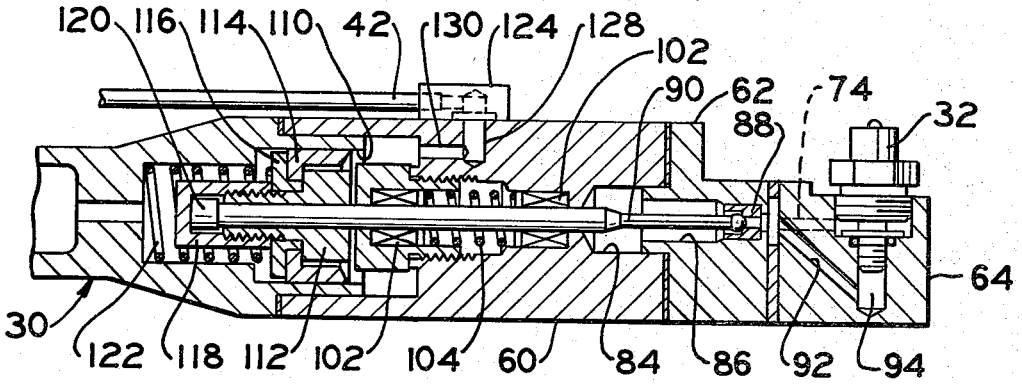
FIG. 5

APPARATUS FOR SPRAYING A COATING ON THE INSIDE SURFACES OF LONGITUDINAL SEAMS ON CAN BODIES

BACKGROUND OF THE INVENTION

This application pertains to the art of coating and, more particularly, to air spraying of coating materials.

The invention is particularly applicable for use in spraying a coating material on the inside surfaces of longitudinal seams on can bodies and will be described with particular reference thereto. However, it will be appreciated that the invention has broader aspects and may be used for air spraying coating materials on the outside surfaces of can body seams or surfaces other than can body seams.

In the manufacture of three-piece cans, it is common to provide a protective metal lining on one surface of a metal strip which is subsequently slit into rectangular blanks. The protective metal lining is also provided with an initial protective coating of suitable material including vinyls, epoxies or phenolics. It is possible to apply this initial protective coating either before or after the metal strip is slit into rectangular blanks. The metal blanks are formed into cylinders with the inside of the cylinders having the protective lining and coating. Opposite side edges of the blanks are secured together by welding, soldering or the use of adhesive to define longitudinal seams. The initial protective coating is not applied to the opposite side edge portions of the blanks which are to be overlapped to form the longitudinal seams. The longitudinal seams form a most vulnerable area where failures are likely to occur due to such imperfections as pinholes and cracks. Therefore, the interior surfaces of the longitudinal seams are commonly provided with a stripe of protective coating material of any suitable type, including vinyls, epoxies and phenolics.

The interior surfaces of the seams are coated with the stripe of protective coating material while the can bodies are moving longitudinally at a high velocity. Therefore, it is necessary that the spraying apparatus for applying the stripe of coating material to the seam area operate in and efficient and reliable manner. Overspraying or splattering results in having the stripe coating material located in undesirable areas beyond the longitudinal seam. The stripe coating material is commonly cured by inductively heating the can body in the area of the seam and the oversprayed or splattered material may remain uncured. In situations where a final protective coating is applied to the entire interior surface of the can body, to cover both the initial coating and the stripe coating, the oversprayed or splattered stripe coating material may not be cured at the relatively lower curing temperatures of the final coating material and this will cause imperfections in the finished coating. Overspraying and splattering can also result in blisters or cracks in the final coating. Application to the seams of a stripe coating which is too thick frequently results in blistering of the stripe coating material or any final coating material which may be applied.

Previous arrangements for applying the impervious stripe coating material to the interior surfaces of the longitudinal seams have included airless-type of spraying devices. Airless sprayers require relatively high pressures to produce a highly dispersed spray and the high pressures make the spray very susceptible to splattering. Increasing the viscosity of the coating material or lowering the pressure can result in a stripe protective coating which is too thick so that blistering occurs. In previous arrangements using air-type spraying devices, the nozzles have been positioned interiorly of the can bodies in such a manner that overspraying is very likely to occur. In addition, the air spraying devices have been made very complicated with a multitude of flow passages and the like.

It would be desirable to thave an air-type spraying device for air spraying coatings on the internal surfaces of longitudinal seams of can bodies in such a manner that overspraying and splattering are substantially eliminated and the coating is of a substantially optimum thickness.

SUMMARY OF THE INVENTION

Internal surfaces of longitudinal seams on can bodies are air sprayed with a protective coating material by spraying the coating material vertically upwardly substantially perpendicular to the longitudinal axes of the can bodies.

In one arrangement, the can bodies travel longitudinally along an elongated arm with their longitudinal seams spaced vertically above the arm. The arm has a longitudinal axis and a terminal end portion, and an air spray nozzle is mounted on the terminal end portion of the arm. The air spray nozzle is of the type to which air and liquid coating material are separately supplied and the coating material is atomized and projected from the nozzle by the air. The nozzle is positioned for spraying the coating material vertically upwardly substantially perpendicular to the longitudinal axis of the arm against the inside surfaces of the longitudinal seams on the can bodies moving past the nozzle.

In a preferred arrangement, a needle valve is carried by the arm for movement between open and closed positions for selectively starting and stopping the flow of coating material to the nozzle. An air operated actuator is provided for moving the needle valve between its open and closed positions independently of air supplied to the nozzle for atomizing the coating material.

Internal flow passages are provided within the arm and a coating material passage is inclined downwardly from the needle valve to the nozzle.

Location of the spray nozzle for directing the coating material vertically upwardly minimizes dripping of liquid coating material from the nozzle and prevents blistering or application of liquid coating material to undesirable areas.

In one arrangement, the elongated arm along which the can bodies travel includes a main body portion carrying the needle valve. A connector block is secured to the main body portion and includes a connector block passage having a valve seat cooperating with the needle valve. A nozzle adaptor block is secured to the connector block and a nozzle is mounted on the nozzle adaptor block. A coating material passage in the nozzle adaptor block extends from the connector block passage to the nozzle.

An air motor is provided in the main body portion of the arm for moving the needle valve to an open position. Independent air supply connections are attached to the main body portion of the arm for independently supplying pressurized air to the air motor and to the spray nozzle. Air for operating the air motor is supplied at approximately 45–60 psig., and atomizing air for the nozzle is supplied at approximately 30–40 psig. Liquid coating material is supplied to its connection on the main body portion at a pressure of approximately 5–8 psig.

Independent internal passages in the arm define coating material supply means, atomizing air supply means and air motor air supply means. The independent internal passages make it possible to independently operate the air motor without affecting the supply of atomizing air for the nozzle. Therefore, operation of the air motor by the air motor air supply means to control the supply of coating material to the nozzle has no effect on the supply of atomizing air to the nozzle. The independent internal passages in the arm preferably enter the arm transversely thereof and extend internally of the arm generally along the arm longitudinal axis. This arrangement makes it very easy to connect the air and coating material supplies to the main body portion of the arm.

The present invention provides an improved apparatus and method for applying a coating material to internal surfaces of longitudinal seams on can bodies.

The invention further provides apparatus and method which substantially eliminates overspray or splattering and makes it very easy to control the thickness of the coating material layer applied to the internal surfaces of the seams.

The invention also provides an improved apparatus and method which substantially eliminates dripping of liquid coating material onto undesired internal surface areas of can bodies.

BRIEF DESCRIPTION OF THE DRAWING

The invention may take form in certain parts and arrangements of parts, a preferred embodiment of which will be described in detail in this specification and illustrated in the accompanying drawings which form a part hereof and wherein:

FIG. 1 is a schematic perspective illustration of a portion of a can manufacturing apparatus with which the improvements of the present application are used;

FIG. 2 is an end elevational view taken generally on lines 2—2 of FIG. 1;

FIG. 5 is a cross-sectional elevational view taken generally on lines 5—5 of FIG. 3.

DESCRIPTION OF A PREFERRED EMBODIMENT

Figure 3:
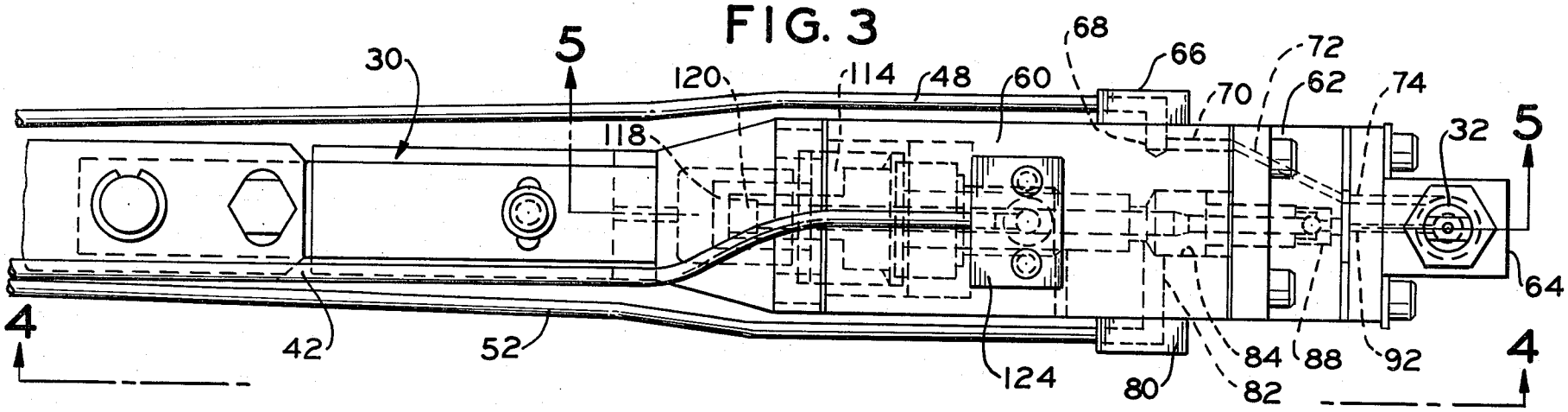
FIG. 3 is a top plan view taken generally on lines 3—3 of FIG. 2.

With reference to the drawings, FIG. 1 shows a stack A of flat rectangular metal blanks 12 which are formed into generally cylindrical can bodies 16 in a known manner. The opposite edges of the can bodies 16 are overlapped and secured together by welding, soldering or the use of adhesive to define a longitudinal seam 20. In the arrangement shown in FIG. 1, an elongated mandrel 22 is provided along which can bodies 16 travel longitudinally as they are formed. Opposed internal and external welding wheels 24 and 26 are provided for welding each longitudinal seam 20. The various equipment for forming the can bodies into a generally cylindrical configuration and moving same longitudinally through the apparatus is very well known in the art. For example, can bodies 16 may be conveyed by being gripped between opposed driven belts while the can bodies are supported on a bottom track or the like.

Downstream of welding wheels 24 and 26, and mandrel 22, an elongated arm 30 has a longitudinal axis extending parallel to the longitudinal direction of movement of can bodies 16. Elongated arm 30 has an outer terminal end portion of which an air spray nozzle 32 is mounted for spraying a liquid coating material on the internal surfaces of longitudinal seams 20 of can bodies 16.

In the preferred arrangement, the apparatus forms can bodies 16 with longitudinal seams 20 thereof positioned vertically upwardly. Air spray nozzle 32 is positioned for spraying a coating material vertically upwardly against the internal surfaces of longitudinal seams 20. A sensing device in the form of a proximity switch or the like 34 may be provided for controlling operation of the spraying device. Sensing device 34 senses the leading and trailing ends of each can body to start and stop operation of the spraying device. Sensing device 34 is connected with a suitable control device 36 for controlling solenoid 38 and for operating valve 40 having a pressurized air supply line 42 connected thereto for supplying air therethrough at a pressure of 45–60 psig. Air supply line 42 extends from the other side of valve 40 to a connector 44 from which air supply lines extend along mandrel 22 and elongated arm 30 to nozzle 32. An air supply line 48 supplies air at a pressure of 30–40 psig to connector 44 for supplying atomizing air to nozzle 32 independently of air supplied through line 42. A suitable tank 50 is provided for a suitable coating material, such as epoxy or phenolic lacquer, which is supplied from the tank 50 to connector 44 through line 52. Lacquer travels from connector 44 through a suitable supply line along mandrel 22 and arm 30 to nozzle 32.

Sensing device 34 is positioned, and operates through control 36, for applying coating material only along the longitudinal seams 20 of can bodies 16, and for interrupting the flow of coating material between the trailing and leading edges of adjacent can bodies. When the spraying of liquid coating material is interrupted, the flow of atomizing air continues so that full high velocity flow of such air is available for immediately atomizing the coating material and projecting the same against the internal surface of a seam when the next can body begins moving past the nozzle.

Figure 4:
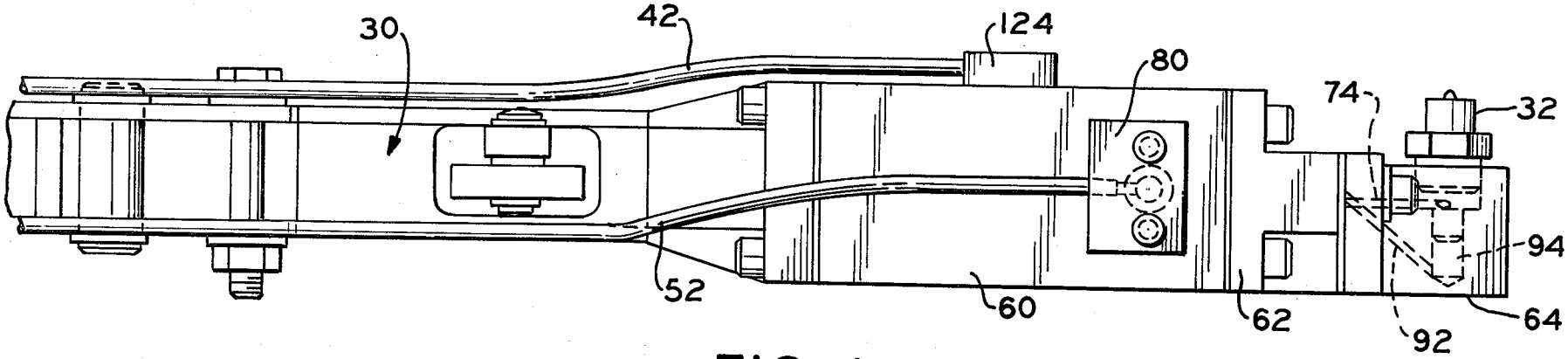
FIG. 4 is a side elevational view taken generally on lines 4—4 of FIG. 3.

As best shown in FIGS. 3–5, elongated arm 30 includes a main body portion 60 having a connector block 62 connected thereto, and a nozzle adaptor block 64 is connected to connector block 62. Main body portion 60 has an air supply connection 66 suitably secured thereto as by bolts for establishing communication for atomizing air supply line 48 to a lateral passage 68 extending transversely into main body portion 60. A longitudinal air passage 70 connects with transverse passage 68 and extends to the terminal end of main body portion 60. A laterally inclined passage 72 in connector block 62 connects air passage 70 with a longitudinal atomizing air passage 74 in nozzle adaptor block 64 which leads to the air passage in air spray nozzle 32.

A liquid coating material connection 80 is suitably secured to main body portion 60 by bolts or the like for establishing communication from liquid coating material supply line 52 to transverse passage 82 in main body portion 60. Transverse passage 82 enters a central cavity 84 in main body portion 60 which is coincidental with a smaller central bore 86 in connector block 62. Bore 86 is reduced at its inner end and has a cylindrical insert 88 positioned therein to define a valve seat cooperating with a needle valve 90 for selectively opening and closing the liquid coating material passage through insert 88 in connector block 62. The passage in insert 88 communicates with a downwardly inclined passage 92 in nozzle adaptor block 64 to communicate with the blind end of a bore 94 which communicates with the liquid coating material supply passage in nozzle 32.

Air spray nozzle 32 may be of many different types and, in one arrangement, is of the type wherein an external swirling flow of air aspirates and atomizes a central supply of liquid coating material for projecting same against a surface. Obviously, suitable gaskets are provided between main body portion 60 and connector block 62, and between connector block 62 and the nozzle adaptor block 64. In addition, the blocks are secured to one another and to the main body portion by suitable bolts extending freely through holes in one and into tapped holes in another.

Suitable packing 102 is provided around needle valve 90, and a coil spring 104 bears against washers to compress the packing 102 for maintaining same in sealing engagement around reciprocating needle valve 90.

An internal bore 110 in main body portion 60 defines a cylinder for a piston attached to the rear end of needle valve 90. Internal bore 110 is considered as a part of main body portion 60 even though main body portion 60 is made of separable parts and bore 110 is actually in a separable left hand part. In the arrangement shown, the piston is in the form of several individual pieces for ease of assembly. Thus, an assembly member 112 received over the rear end portion of needle valve 90 has a cup member 114 and a stepped member 116 received thereon as shown in FIG. 5. A sleeve member 118 is threaded onto assembly member 112 for trapping enlarged rear end 120 on needle valve 90. A coil spring 122 normally biases against member 116 for biasing the piston and needle valve 90 to the right so that needle valve 90 closes the passage through insert 88.

A connection 124 establishes communication from air supply conduit 42 to a lateral passage 128 in main body portion 60. A longitudinal passage 130 extends from lateral passage 128 to enter cylinder 110. The piston and cylinder provided around the rear end portion of the needle valve defines an air motor for moving the needle valve between open and closed positions. Spring 122 defines a yieldable biasing means for normally biasing needle valve 90 to its closed position. Supply of pressurized air through line 42, connection 124 and the passages 128 and 130 operate the air motor for moving needle valve 90 to the left in FIG. 5 to an open position for flow of liquid coating material to air spray nozzle 32. Operation of a suitable valve for exhausting the pressurized air to atmosphere will exhaust the pressurized air from cylinder 110 so that spring 122 again rapidly moves needle valve 90 to its closed position.

Sensing device 34 of FIG. 1 operates through control 36 and valve 40 to operate the air motor for moving needle valve 90 to its open position for supplying liquid coating material to air spray nozzle 32 only while a can body is moving past air spray nozzle 32 for coating the internal surfaces of the longitudinal seams. Valve 40 operates for closing needle valve 90 to stop the flow of coating material to nozzle 32 as the spaces between trailing and leading edges of can bodies move past nozzle 32. Pressurized air for atomizing and projecting the coating material is continuously supplied to air spray nozzle 32 through conduit 48. Thus, the supplies of atomizing air and air for the air motor are completely independent of one another.

Needle valve 90 defines valve means for starting and stopping flow of coating material to nozzle 32 independently of the supply of atomizing air to the nozzle. The atomizing air supply means is defined by line 48 and the internal passages at 68,70,72 and 74. The air motor air supply means is generally defined by line 42 and the internal passages in arm 30 at 128 and 130. The coating material supply means is generally defined by line 52 and the internal passages in arm 30 at 84,86 and 92, along with the passage around the valve seat in insert 38 within connector block 62. All of the coating material supply means, atomizing air supply means and air motor air supply means operate independently of one another so that operation of the air motor by the air motor air supply means to control the supply of coating material to the nozzle has no effect on the flow of atomizing air to the nozzle.

As best shown in FIG. 2, a fine spray is generally indicated at 140 directed substantially vertically upwardly from air spray nozzle 32 against the interior surface of a longitudinal seam 20 on a can body 16. Atomized spray 140 is directed generally perpendicular to the longitudinal axis of arm 30 and to the longitudinal axis of can body 16. The arrangement shown and described substantially eliminates overspray and splattering. However, it will be recognized that it is possible to provide additional side air knives or the like if so desired to further minimize any overspray. In one arrangement, the air supplies have been provided at 30–40 psig, while the liquid coating material is supplied at a pressure of around 5–8 psig. It will be recognized that other pressures can be used if so desired depending upon the application and viscosity of the coating material. Projecting the coating material in a spray substantially radially of the longitudinal axis of the can body has been found to minimize overspray. Location of the cooperating needle valve and valve seat very close to nozzle 32 insures very rapid cut-off of coating material being projected against the internal surface of a seam so that very little overspray occurs beyond the terminal end of a can body being coated.

The air operated actuator for moving needle valve 90 is in the form of an air motor including a piston attached to the rear end portion of the needle valve and slidably positioned within cylinder 110 of FIG. 5. This arrangement provides very rapid starting and stopping of spraying, and dripping of liquid coating material from the nozzle is substantially eliminated.

The invention has been described with reference to the preferred embodiment. While this preferred arrangement is with regard to coating the inside surface of can body seams, it will be appreciated that the invention could also be used for coating the outside surfaces of such seams or surfaces other than can body seam without in any way departing from the overall intent or scope of the present invention. Further, modifications and alterations will occur to others upon the reading and understanding of this specification. The present invention, however, includes all such equivalent modifications and alterations insofar as they come within the scope of the appended claims or the equivalents thereof.

Having thus described the invention, I claim:

1. Apparatus for spraying a coating on the inside surfaces of longitudinal seams on can bodies or the like, said apparatus comprising: an elongated arm having a longitudinal axis and a terminal end portion; means for moving longitudinally seamed can bodies along said arm longitudinally with the longitudinal seams spaced vertically above said arm; an air spray nozzle of the type to which air and liquid coating material are separately supplied and the coating material is atomized and projected from the nozzle by the air; said air spray nozzle being mounted on said terminal end portion of said arm in a position for spraying a coating material vertically upwardly in a direction extending perpendicular to said longitudinal axis of said arm and radially of the longitudinal axis of the can bodies for applying a uniform layer of coating material against the inside surfaces of longitudinal seams on can bodies moving past said nozzle and minimizing overspray, splattering and dripping of the coating material; a needle valve carried by said arm for movement between open and closed positions for selectively starting and stopping flow of coating material to said nozzle; an air operated actuator for moving said needle valve between said open and closed positions independently of air supplied to said nozzle for atomizing the coating material; and, air supply means for supplying air to said actuator at a pressure greater than the pressure of the air supplied to said nozzle for providing rapid operation of said needle valve while maintaining relatively low pressure air spraying of the coating material to minimize splattering and overspray.

2. The apparatus as defined in claim 1 further including a coating material passage in said arm inclined downwardly from said needle valve to an upwardly extending flow passage leading to said nozzle.

3. The apparatus as defined in claim 1 wherein said arm includes a main body portion carrying said needle valve; a connector block secured to said main body portion and including a connector block passage having a valve seat cooperating with said needle valve; a nozzle adaptor block secured to said connector block, said nozzle being mounted on said nozzle adaptor block; and, a coating material passage in said nozzle adaptor block extending from said connector block passage to said nozzle.

4. The apparatus as defined in claim 3 including yieldable biasing means for biasing said needle valve to said closed position; a cylinder in said main body portion around said needle valve; a piston secured to said needle valve and positioned in said cylinder; and, two independent air supply connections attached to said main body portion, one said air supply connection communicating with said cylinder through a passage in said main body portion for moving said piston against the force of said yieldable biasing means in a direction for opening said needle valve and the other said air supply connection communicating with said nozzle through air passages in said main body portion, connector block and nozzle adaptor block.

5. The apparatus as defined in claim 1 including air supply means for supplying air to said nozzle at a pressure of approximately 30–40 psig and liquid coating material supply means for supplying liquid coating material to said nozzle at a pressure of approximately 5–8 psig.

6. The apparatus as defined in claim 1 further including a sensing device for sensing trailing and leading ends of can bodies and operating said needle valve to supply coating material therepast to said nozzle only when the longitudinal seams on can bodies are moving past said nozzle and to interrupt the supply of coating material to said nozzle between trailing and leading ends of successive can bodies moving past said nozzle; and, said air supply means providing a continuous flow of atomizing air to said nozzle regardless of whether said needle valve is open or closed so that dripping of coating material is eliminated when said needle valve is moved to closed position and full flow of atomizing air is available to immediately atomize the coating material upon opening of the needle valve.

* * * * *